US011946329B2

(12) United States Patent
Brown

(10) Patent No.: US 11,946,329 B2
(45) Date of Patent: Apr. 2, 2024

(54) PISTON-LESS DOWNHOLE TOOLS AND PISTON-LESS PRESSURE COMPENSATION TOOLS

(71) Applicant: Halliburton Energy Services, Inc., Houston, TX (US)

(72) Inventor: Irvine Brown, Abderdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 17/561,208

(22) Filed: Dec. 23, 2021

(65) Prior Publication Data

US 2023/0203902 A1 Jun. 29, 2023

(51) Int. Cl.
*E21B 23/04* (2006.01)
*E21B 23/10* (2006.01)

(52) U.S. Cl.
CPC ..... *E21B 23/04* (2013.01); *E21B 23/10* (2013.01)

(58) Field of Classification Search
CPC ... E21B 23/04; E21B 23/0412; E21B 23/0415
See application file for complete search history.

(56) References Cited

U.S. PATENT DOCUMENTS

2007/0074872 A1 4/2007 Du et al.
2009/0277628 A1* 11/2009 Watson ..... F04D 15/0209 166/250.01
2015/0322770 A1 11/2015 Meyer et al.
2015/0354327 A1 12/2015 Semple et al.

FOREIGN PATENT DOCUMENTS

EP 2501897 B1 6/2014
WO 2011140238 A2 11/2011

OTHER PUBLICATIONS

International Search Report and Written Opinion dated Sep. 15, 2022 in PCT/US2021/065396 (11 pages).

* cited by examiner

*Primary Examiner* — Cathleen R Hutchins
(74) *Attorney, Agent, or Firm* — Barnes & Thornburg, LLP

(57) ABSTRACT

Piston-less downhole tools and piston-less pressure compensation tools are presented. The piston-less downhole tool includes a first chamber comprising a first fluid, the first fluid being a fluid that thermally expands in response to an increase in a temperature of the first fluid. The piston-less downhole tool also includes a tubular having a first end that is fluidly sealed and a second end that is in fluid communication with the first fluid, wherein the tubular is configured to expand in response to thermal expansion of the first fluid. The piston-less downhole tool further includes a second chamber configured to store a second fluid. The tubular of the piston-less downhole tool is configured to contract in response to pressure applied by the second fluid.

20 Claims, 2 Drawing Sheets

PISTON-LESS DOWNHOLE TOOLS AND PISTON-LESS PRESSURE COMPENSATION TOOLS

BACKGROUND

The present disclosure relates generally to piston-less downhole tools and piston-less pressure compensation tools.

Downhole tools having pistons are sometimes deployed in hydrocarbon wellbores during wireline, completion, intervention, and other well operations. The pistons are sometimes configured to actuate tools and devices, open and close valves, shift sleeves and covers, compensate fluid expansion and contraction, and perform other well operations. However, pistons contain mechanical components that are subject to wear and tear, corrosion, and deterioration due to adverse downhole conditions. Similarly, components that hold the pistons in place or protect the pistons are also subject to wear and tear, corrosion, and deterioration due to the adverse downhole conditions.

BRIEF DESCRIPTION OF THE DRAWINGS

Illustrative embodiments of the present disclosure are described in detail below with reference to the attached drawing figures, which are incorporated by reference herein, and wherein.

Figure 1:
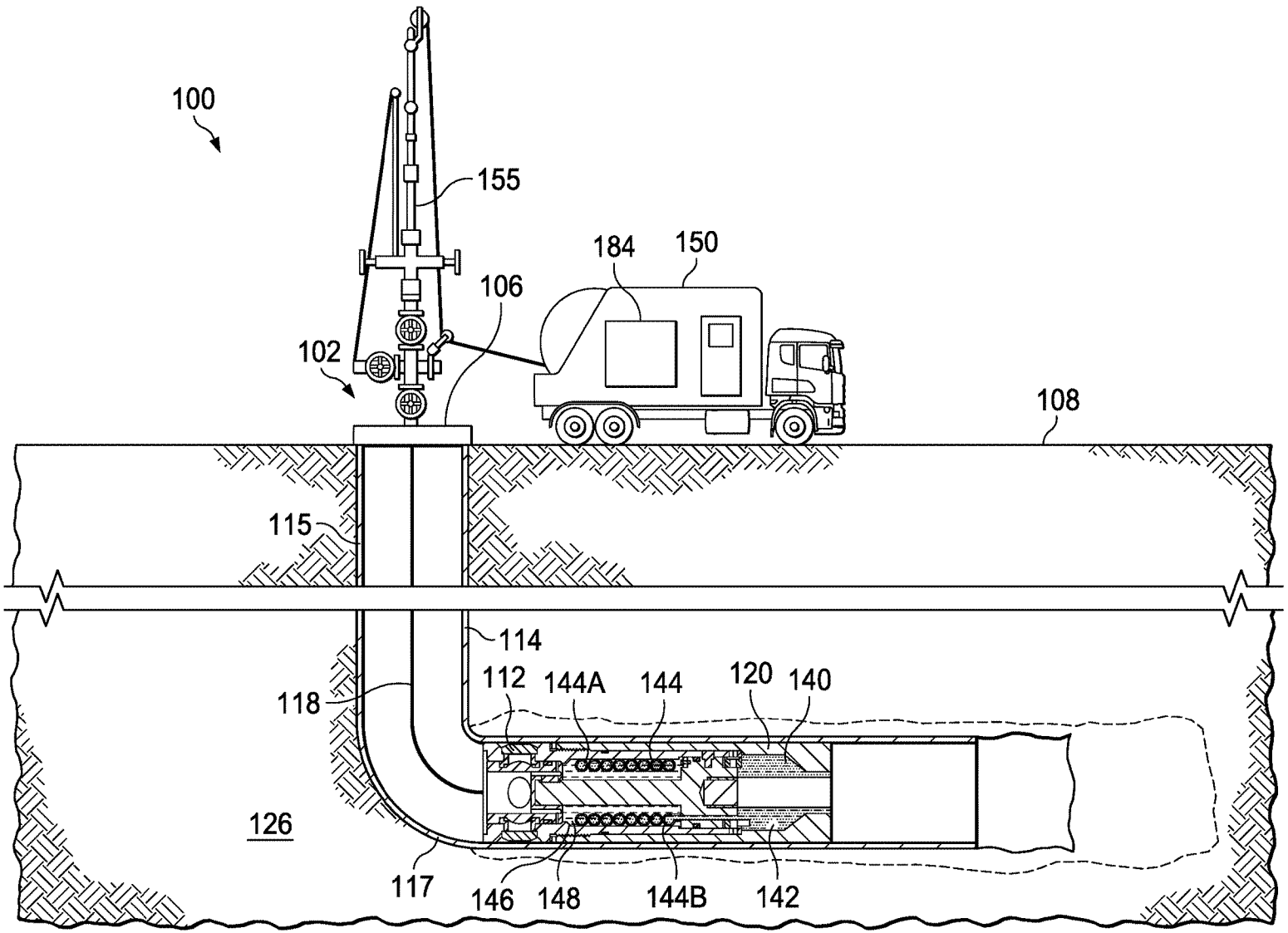
FIG. 1 is a schematic, side view of an environment in which a bottomhole assembly that is coupled to a piston-less downhole tool is lowered into a wellbore via a wireline.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to piston-less downhole tools and piston-less pressure compensation tools. As referred to herein, a piston-less downhole tool refers to any tool that does not include a piston. Further, and as referred to herein, a piston-less pressure compensation tool refers to any tool that does not utilize a pressure compensated piston or a piston as a pressure compensator. In some embodiments, a piston-less pressure compensation tool includes or is coupled to a piston, such as a piston configured to open or close valves, shift screens, and to perform other operations, provided that the piston is not used as a pressure compensator or as a pressure compensated piston.

The piston-less downhole tool includes a chamber (first chamber) that holds a fluid (first fluid) that undergoes thermo expansion in response to a temperature increase of the fluid. In some embodiments, the first chamber is a chamber of a motor assembly that holds a motor, and the first fluid is motor oil for the motor. The piston-less downhole tool also includes a tubular having one end (first end) that is fluidly sealed and another end (second end) that is in fluid communication with the first fluid, such as, for example through the first chamber, via a port that fluidly connects the second end to the first chamber, or via another component that fluidly connects the second end to the first chamber. As referred to herein, a tubular is any structure having a hollow interior. In some embodiments, the tubular is helically shaped, circular shaped, oval shaped, or has a different shape. The tubular is formed from a material (such as a flexible material) that expands in response to thermal expansion of a fluid, such as the first fluid. Examples of materials used to form the tubular include, but are not limited to metal, plastic elastomer, rubber, synthetic rubber, fluoropolymer elastomer, or anther material having properties that allow the material to expand or contract in response to pressure applied to the material. In some embodiments, thermal expansion of the first fluid causes the tubular to expand radially outwards, such as for example, radially outwards away from a longitudinal central axis of the tubular. Continuing with the foregoing example, where the first fluid is motor oil, the ambient downhole temperature causes the motor oil to heat up, which in turn expands. Expansion of the motor oil inside the tubular applies a pressure against an interior surface of the tubular. Further, although the interior surface of the tubular prevents the motor fluid from flowing through the interior surface, pressure applied by the motor fluid causes the tubular to radially expand.

The piston-less downhole tool also includes a second chamber that is configured to store another fluid, such as reservoir fluid, a fluid that is pumped downhole, or another type of fluid. In some embodiments, the second fluid flows into the second chamber (e.g., through one or more ports) as the piston-less downhole tool is run downhole. Hydrostatic pressure of the second fluid in the second chamber builds as the piston-less downhole tool traverses downhole, and pressure applied by the second fluid onto the exterior surface of the tubular causes the tubular to reduce in volume. In one or more of such embodiments, the pressure applied by the second fluid onto the exterior surface of the tubular counteracts the pressure applied by thermal expansion of the first fluid onto the interior surface of the tubular, where the volume of the tubular is maintained at the initial volume of the tubular before any pressure is applied to the tubular by the first or the second fluid, or within a threshold of the initial volume (e.g., 1%, 3%, 5%, or another threshold). Continuing with the foregoing example, and assuming that pressure due to the thermal expansion of the motor oil causes the tubular to increase its volume from 100 cubic centimeters to 110 cubic centimeters, pressure applied by the reservoir oil onto the exterior surface of the tubular causes the tubular to decrease its volume from 110 cubic centimeters to 100 cubic centimeters, or to another volume that is within a threshold of the initial volume of the tubular prior to thermal expansion of the motor oil. In some embodiments, the pressure applied by the second fluid pressure compensates the second pressure applied by the thermal expansion of the first fluid to maintain a volume of the tubular within a threshold volume of an initial volume of the tubular prior to the increase in the temperature of the first fluid.

The piston-less pressure compensation tool, similar to the piston-less downhole tool, also includes a first chamber that holds a first fluid that thermally expands in response to an increase in the temperature of the first fluid, a tubular having a first end that is fluidly sealed and a second end that is in fluid communication with the first fluid, and a second chamber that is configured to store a second fluid, such as a reservoir fluid. Additional descriptions of the first chamber, the second chamber and the tubular are provided in the paragraphs below and are illustrated in at least FIGS. 1 and 2.

Turning now to the figures, FIG. 1 is a schematic, side view of an environment 100 in which a piston-less downhole tool 112 is lowered into a wellbore 114 via a wireline 118. As shown in FIG. 1, wellbore 114 has a vertical section 115 that extends from a wellhead 106 at a surface 108 downwards to a formation 126, and a lateral section 117 that extends laterally or horizontally through formation 126. A wireline vehicle 150 is positioned near wellhead 106 to deploy wireline 118 through wellhead 106 into wellbore 114. A lubricator 155 is positioned above wellhead 106 to facilitate lowering wireline 118 down wellbore 114 and lifting wireline 118 up from wellhead 106 of a well 102.

In the embodiment of FIG. 1, piston-less downhole tool 112 has a chamber 140 that is filled with a first fluid 142 such as motor oil, a tubular 144, and a chamber 146 that is configured to hold a second fluid 148 such a reservoir fluid. Tubular 144 has a first end 144A that is fluidly sealed and a second end 144B that provides fluid communication with chamber 140 such that first fluid 142 also flows into tubular 144. First fluid 142 is a fluid that undergoes thermal expansion, such that the volume of first fluid 142 increases in response to an increase to the temperature of first fluid 142. As the temperature of first fluid 142 increases, thermal expansion of first fluid 142 applies a pressure to an interior surface of tubular 144, thereby causing tubular 144 to also expand (such as radially outwards). Second fluid 148 is introduced into chamber 146 to pressure compensate the pressure applied by first fluid 142. Additional descriptions of piston-less downhole tools and components of piston-less downhole tools are provided in the paragraphs below and are illustrated in at least FIG. 2.

Although FIG. 1 illustrates a wireline environment, piston-less downhole tools such as piston-less downhole tool 112 are also deployable during completion, intervention, during MWD/LWD, and other types of well operations or in other types of well environments. Further, although FIG. 1 illustrates wireline 118 that is coupled to piston-less downhole tool 112, in some embodiments, another type of conveyance (such as a coiled tubing, a drill pipe, or a production tubing) is coupled to piston-less downhole tool 112 to deploy and retract piston-less downhole tool 112. In some embodiments, piston-less downhole tool is coupled to another component or another tool that is deployed downhole. In some embodiments, piston-less downhole tool is a component or is coupled to a bottomhole assembly, or another assembly that is deployed downhole. Further, although FIG. 1 illustrates a cased wellbore, piston-less downhole tools such as piston-less downhole tool 112, are deployable in open-hole wellbores, and cased wellbores and open-hole wellbores of offshore wells.

Figure 2:
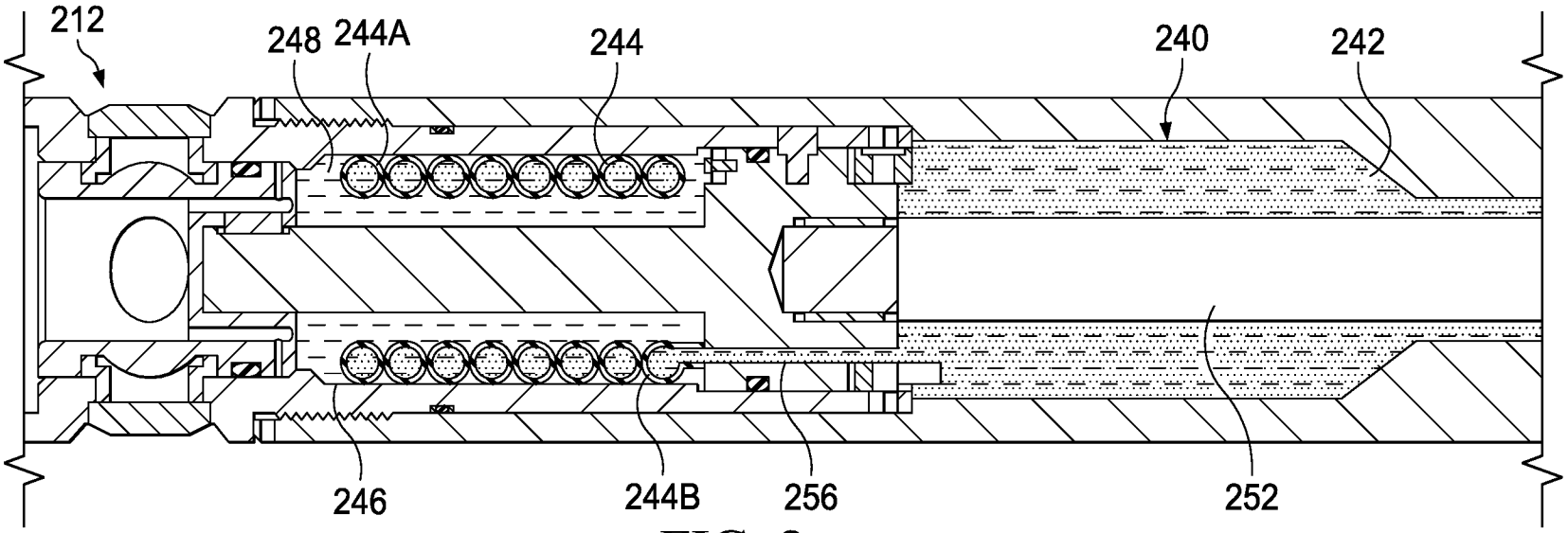
FIG. 2 is a cross-sectional view of a piston-less downhole tool similar to the piston-less downhole tool of FIG. 1, and coupled to a bottomhole assembly.

FIG. 2 is a cross-sectional view of a piston-less downhole tool 212 similar to piston-less downhole tool 112 of FIG. 1. In the embodiment of FIG. 2, piston-less downhole tool 212 has a first chamber 240 that stores a first fluid 242, such as motor oil, and a second chamber 246 that is configured to hold a second fluid 248, such as a reservoir fluid. In some embodiments, reservoir fluid flows into second chamber 246 as piston-less downhole tool 212 is run downhole.

Piston-less downhole tool 212 also includes a tubular 244 having a first end 244A that is fluidly sealed and a second end 244B that permits first fluid 242 to flow into a hollow interior of tubular 244. In the embodiment of FIG. 2, second end 244B of tubular 244 is fluidly connected to first chamber 240 via a port 256. Tubular 244 has a surface that prevents fluid flow through either side (interior and exterior) of the surface. For example, the surface of tubular 244 prevents first fluid 242 within the hollow interior of tubular 244 from flowing through the interior surface out of tubular 244 and also prevents fluids outside of the exterior surface of tubular 244 from flowing through the exterior surface of tubular 244. Tubular 244 is formed from a flexible material that expands or contracts in response to pressure applied to the surface of tubular 244. In one or more of such embodiments, the flexible material is formed from a metal, plastic elastomer, rubber, synthetic rubber, fluoropolymer elastomer, or another material having elastic properties. In some embodiments, tubular 244 is wrapped (such as helically wrapped) around an interior section of second chamber 246. In some embodiments, tubular 244 has a square, circular, oval, or another shape.

In the embodiment of FIG. 2, piston-less downhole tool 212 also has a motor assembly 252. While a motor of motor assembly 252 is running, first fluid 242 is pumped into motor assembly 252. The ambient downhole temperature at the location of downhole tool 212 causes the temperature of first fluid 242 to increase, which in turn causes thermal expansion of first fluid 242 in tubular 244. The thermal expansion of first fluid 242 applies pressure to the interior surface of tubular 244, which causes tubular 244 to expand. In some embodiments, the pressure applied by thermal expansion of first fluid 242 causes tubular 244 to expand radially outwards. However, hydrostatic pressure of second fluid 248 increases as piston-less downhole tool 212 traverses downhole, and second fluid 248 applies pressure (or increased pressure) to the exterior surface of tubular 244 such that the pressure applied by second fluid 248 pressure compensates pressure due to thermal expansion of first fluid 242. In some embodiments, where thermal expansion of first fluid 242 increases a volume of tubular 244 by a first volume (e.g., 50 cubic centimeters), pressure applied by second fluid 248 reduces the volume of tubular 244 by the first volume or reduces the volume of tubular 244 to a threshold volume within the original volume of tubular 244 prior to thermal expansion of first fluid 242.

Although the foregoing paragraphs describe a piston-less downhole tool 212, it is understood that the foregoing descriptions of the components of piston-less downhole tool 212 also describe the components of a piston-less pressure compensation tool. Further, although piston-less downhole tool 212 of FIG. 2 has a motor assembly 252, in some embodiments, motor assembly 252 is not component of piston-less downhole tool 212 but is coupled to piston-less downhole tool 212. In some embodiments, operations described herein to pressure compensate pressure applied by first fluid 242 are performed even when piston-less downhole tool 212 does not have a motor assembly and is not coupled to a motor assembly. Further, in some embodiments, second chamber 246 is positioned downhole of first chamber 240.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure.

Clause 1, a piston-less downhole tool, comprising a first chamber comprising a first fluid, the first fluid being a fluid that thermally expands in response to an increase in a temperature of the first fluid; a tubular having a first end that is fluidly sealed and a second end that is in fluid communication with the first fluid, wherein the tubular is configured to expand in response to thermal expansion of the first fluid; and a second chamber configured to store a second fluid, wherein the tubular is configured to contract in response to pressure applied by the second fluid.

Clause 2, the piston-less downhole tool of clause 1, wherein the tubular is wrapped around an interior section of the second chamber, and wherein an exterior surface of the tubular is in fluid communication of with second fluid when the second chamber is partially filled by the second fluid.

Clause 3, the piston-less downhole tool of clause 2, wherein the pressure applied by the second fluid is applied to the exterior surface of the tubular, and wherein the thermal expansion of the first fluid applies a second pressure to an interior surface of the tubular.

Clause 4, the piston-less downhole tool of clause 3, wherein the pressure applied by the second fluid compensates the second pressure applied by the thermal expansion of the first fluid to maintain a volume of the tubular within a threshold volume of an initial volume of the tubular prior to the increase in the temperature of the first fluid.

Clause 5, the piston-less downhole tool of clauses 3 or 4, wherein the second pressure due to the thermal expansion of the first fluid extends radially outwards from the tubular, and wherein the pressure applied by the second fluid extends inwards to the tubular.

Clause 6, the piston-less downhole tool of any of clauses 2-5, wherein the tubular is helically wrapped around the interior section of the second chamber.

Clause 7, the piston-less downhole tool of any of clauses 1-6, wherein the tubular is formed from a flexible material.

Clause 8, the piston-less downhole tool of clause 7, wherein the flexible material is a metal, plastic elastomer, rubber, synthetic rubber, or fluoropolymer elastomer.

Clause 9, the piston-less downhole system of clauses 7 or 8, wherein the flexible material of the tubular expands a threshold volume in response a threshold amount of temperature increase, and wherein the flexible material of the tubular is compressed by the threshold volume in response to the pressure applied by the second fluid to the flexible material being a threshold amount of pressure.

Clause 10, the piston-less downhole tool of any of clauses 1-9, further comprising a motor, wherein the first fluid is motor fluid for the motor.

Clause 11, the piston-less downhole tool of any of clauses 1-10, further comprising a port that fluidly connects the first chamber with the second end of the tubular.

Clause 12, the piston-less downhole tool of any of clauses 1-11, wherein the piston-less downhole tool is a wireline tool that is deployed downhole via a wireline.

Clause 13, a piston-less pressure compensation tool, comprising a first chamber comprising a first fluid, the first fluid being a fluid that thermally expands in response to an increase in a temperature of the first fluid; a tubular having a first end that is fluidly sealed and a second end that is in fluid communication with the first fluid, wherein the tubular is configured to expand in response to thermal expansion of the first fluid; and a second chamber configured to store a second fluid, wherein the tubular is configured to contract in response to pressure applied by the second fluid, and wherein the pressure applied by the second fluid compensates a second pressure applied by the thermal expansion of the first fluid to maintain a volume of the tubular within a threshold volume of an initial volume of the tubular prior to the increase in the temperature of the first fluid.

Clause 14, the piston-less pressure compensation tool of clause 13, wherein the tubular is wrapped around an interior section of the second chamber, and wherein an exterior surface of the tubular is in fluid communication with the second fluid when the second chamber is partially filled by the second fluid.

Clause 15, the piston-less pressure compensation tool of clause 14, wherein the pressure applied by the second fluid is applied to the exterior surface of the tubular, and wherein the thermal expansion of the first fluid applies a second pressure to an interior surface of the tubular.

Clause 16, the piston-less pressure compensation tool of any of clauses 13-15, wherein the tubular is formed from a flexible material, wherein the flexible material of the tubular expands a threshold volume in response a threshold amount of temperature increase, and wherein the flexible material of the tubular is compressed by the threshold volume in response to the pressure applied by the second fluid to the flexible material being a threshold amount of pressure.

Clause 17, the piston-less pressure compensation tool of any of clauses 13-16, wherein the second pressure due to the thermal expansion of the first fluid extends radially outwards from the tubular, and wherein the pressure applied by the second fluid extends inwards to the tubular.

Clause 18, the piston-less pressure compensation tool of any of clauses 13-17, wherein the tubular is helically wrapped around the interior section of the second chamber.

Clause 19, the piston-less pressure compensation tool of any of clauses 13-18, further comprising a motor, wherein the first fluid is motor fluid for the motor.

Clause 20, the piston-less pressure compensation tool of any of clauses 13-19, further comprising a port that fluidly connects the first chamber with the second end of the tubular.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A piston-less downhole tool, comprising:

a first chamber comprising a first fluid, the first fluid being a fluid that thermally expands in response to an increase in a temperature of the first fluid;

a tubular having a first end that is fluidly sealed and a second end that is in fluid communication with the first fluid, wherein the tubular is configured to expand in response to thermal expansion of the first fluid; and a second chamber configured to store a second fluid, wherein the tubular is configured to contract in response to pressure applied by the second fluid, and wherein the first end isolates the first fluid from the second fluid.

2. The piston-less downhole tool of claim 1, wherein the tubular is wrapped around an interior section of the second chamber, and wherein an exterior surface of the tubular is in fluid communication of with second fluid when the second chamber is partially filled by the second fluid.

3. The piston-less downhole tool of claim 2, wherein the pressure applied by the second fluid is applied to the exterior surface of the tubular, and wherein the thermal expansion of the first fluid applies a second pressure to an interior surface of the tubular.

4. The piston-less downhole tool of claim 3, wherein the pressure applied by the second fluid compensates the second pressure applied by the thermal expansion of the first fluid to maintain a volume of the tubular within a threshold volume of an initial volume of the tubular prior to the increase in the temperature of the first fluid.

5. The piston-less downhole tool of claim 3, wherein the second pressure due to the thermal expansion of the first fluid extends radially outwards from the tubular, and wherein the pressure applied by the second fluid extends inwards to the tubular.

6. The piston-less downhole tool of claim 2, wherein the tubular is helically wrapped around the interior section of the second chamber.

7. The piston-less downhole tool of claim 1, wherein the tubular is formed from a flexible material.

8. The piston-less downhole tool of claim 7, wherein the flexible material is a metal, plastic elastomer, rubber, synthetic rubber, or fluoropolymer elastomer.

9. The piston-less downhole system of claim 7, wherein the flexible material of the tubular expands a threshold volume in response a threshold amount of temperature increase, and wherein the flexible material of the tubular is compressed by the threshold volume in response to the pressure applied by the second fluid to the flexible material being a threshold amount of pressure.

10. The piston-less downhole tool of claim 1, further comprising a motor, wherein the first fluid is motor fluid for the motor.

11. The piston-less downhole tool of claim 1, further comprising a port that fluidly connects the first chamber with the second end of the tubular.

12. The piston-less downhole tool of claim 1, wherein the piston-less downhole tool is a wireline tool that is deployed downhole via a wireline.

13. A piston-less pressure compensation tool, comprising:

a first chamber comprising a first fluid, the first fluid being a fluid that thermally expands in response to an increase in a temperature of the first fluid;

a tubular having a first end that is fluidly sealed and a second end that is in fluid communication with the first fluid, wherein the tubular is configured to expand in response to thermal expansion of the first fluid; and a second chamber configured to store a second fluid, wherein the first end isolates the first fluid from the second fluid, wherein the tubular is configured to contract in response to pressure applied by the second fluid, and wherein the pressure applied by the second fluid compensates a second pressure applied by the thermal expansion of the first fluid to maintain a volume of the tubular within a threshold volume of an initial volume of the tubular prior to the increase in the temperature of the first fluid.

14. The piston-less pressure compensation tool of claim 13, wherein the tubular is wrapped around an interior section of the second chamber, and wherein an exterior surface of the tubular is in fluid communication with the second fluid when the second chamber is partially filled by the second fluid.

15. The piston-less pressure compensation tool of claim 14, wherein the pressure applied by the second fluid is applied to the exterior surface of the tubular, and wherein the thermal expansion of the first fluid applies a second pressure to an interior surface of the tubular.

16. The piston-less pressure compensation tool of claim 13, wherein the tubular is formed from a flexible material, wherein the flexible material of the tubular expands a threshold volume in response a threshold amount of temperature increase, and wherein the flexible material of the tubular is compressed by the threshold volume in response to the pressure applied by the second fluid to the flexible material being a threshold amount of pressure.

17. The piston-less pressure compensation tool of claim 13, wherein the second pressure due to the thermal expansion of the first fluid extends radially outwards from the tubular, and wherein the pressure applied by the second fluid extends inwards to the tubular.

18. The piston-less pressure compensation tool of claim 13, wherein the tubular is helically wrapped around the interior section of the second chamber.

19. The piston-less pressure compensation tool of claim 13, further comprising a motor, wherein the first fluid is motor fluid for the motor.

20. The piston-less pressure compensation tool of claim 13, further comprising a port that fluidly connects the first chamber with the second end of the tubular.

* * * * *